US005431397A

United States Patent [19]

Eckel et al.

[11] Patent Number: 5,431,397

[45] Date of Patent: Jul. 11, 1995

[54] TABLE TOP SOCCER GAME APPARATUS

[76] Inventors: Werner K. Eckel; Ulrich H. Eckel, both of 48 Calle Del Norte, Rancho Santa Margarta, Calif. 91730

[21] Appl. No.: 240,631

[22] Filed: May 11, 1994

[51] Int. Cl.[6] ..... A63F 7/06

[52] U.S. Cl. ..... 273/85 R; 273/126 R; 273/284

[58] Field of Search ..... 273/94 R, 85 R, 85 F, 273/126 R, 284, 285, 286, 287

[56] References Cited

U.S. PATENT DOCUMENTS

| | | | |
|---|---|---|---|
| D. 246,674 | 12/1977 | Cecchetti . | |
| 3,806,119 | 4/1974 | Mosciatti . | |
| 4,257,599 | 3/1981 | Cutri . | |
| 4,274,635 | 6/1981 | Pakogian . | |
| 5,092,595 | 3/1992 | Daravina . | |
| 5,110,127 | 5/1992 | Potter | 273/94 X |
| 5,242,164 | 9/1993 | Nicoll | 273/126 R X |

FOREIGN PATENT DOCUMENTS

| | | | |
|---|---|---|---|
| 24702 | of 1904 | United Kingdom | 273/85 R |
| 27284 | of 1909 | United Kingdom | 273/85 R |
| 150166 | 9/1920 | United Kingdom | 273/85 R |
| 341651 | 1/1931 | United Kingdom | 273/85 R |
| 341998 | 1/1931 | United Kingdom | 273/85 R |
| 663529 | 12/1951 | United Kingdom | 273/85 R |

*Primary Examiner*—Sebastiano Passaniti

[57] ABSTRACT

A new and improved table top soccer game apparatus includes a planar simulated soccer field assembly adapted to be placed on a table top. The simulated soccer field assembly includes four passing zones, a first passing zone, a second passing zone, a third passing zone, and a fourth passing zone. The simulated soccer field assembly includes a first goal area and a second goal area located at opposite ends of the simulated soccer field assembly. A plurality of first players is comprised of a first team and a plurality of second players is comprised of a second team adapted to slide along the simulated soccer field assembly. The first players and the second players adapted to be propelled by a squeezing action between an index finger and a thumb, and a projectile adapted to be slid along the simulated soccer field assembly by is bumped by the propelled first players and the propelled second players. The projectile is in a form of a cylindrical shape. The first players are color coded with a first color, and the second players are color coded with a second color. A wall assembly may be connected to the simulated soccer field assembly adjacent to a perimeter of the simulated soccer field assembly. The wall assembly projects upward from the simulated soccer field assembly. An overlay assembly is provided which simulates a hockey rink. The overlay assembly is adapted to placed over the simulated soccer field assembly.

1 Claim, 4 Drawing Sheets

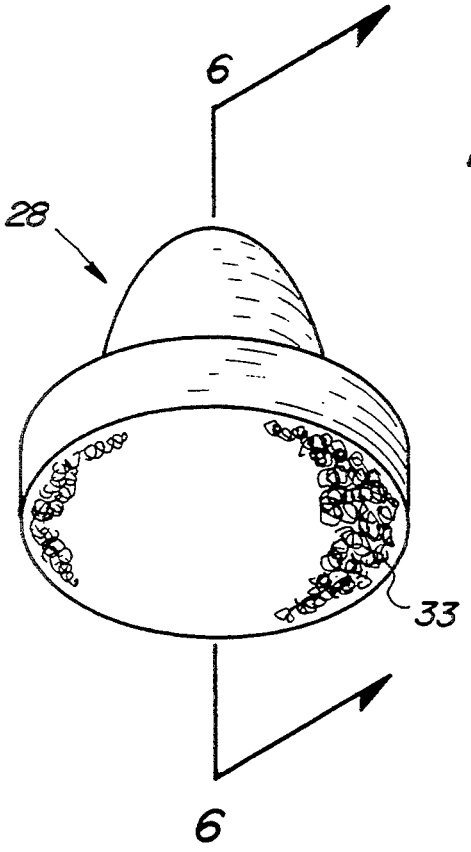
FIG. 5
FIG. 6
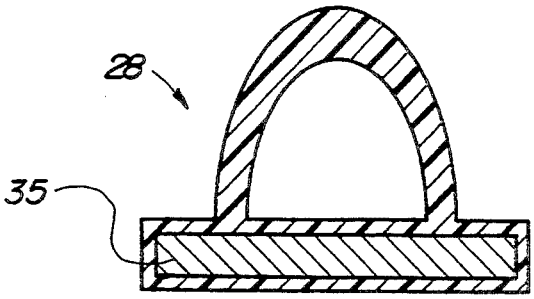
FIG. 7
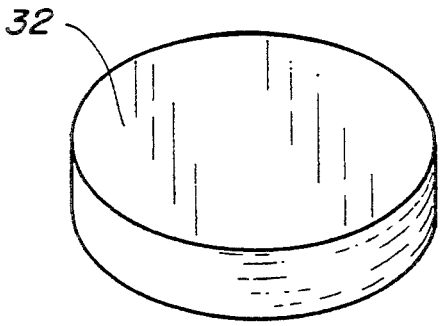

TABLE TOP SOCCER GAME APPARATUS

BACKGROUND OF THE INVENTION

1. Field of the Invention

The present invention relates generally to games played on a table top and, more particularly, to a table top game that simulates the game of soccer.

2. Description of the Prior Art

Throughout the world, the game of soccer is played by millions and watched by even more. Although many people may be physically unable to play soccer, many people would like to derive some of the excitement of a soccer game without playing an actual game. In response to this desire, table top games have been developed that simulate soccer.

Throughout the years, a number of innovations have been developed relating to table top soccer games, and the following U.S. Pat. Nos. are representative of some of those innovations: 3,806,119; 4,257,599; 4,274,635; 5,092,595; and Des. 246,674. More specifically, U.S. Pat. No. 3,806,119 discloses a miniature soccer-football game toy that include simulated player that move in accordance with predetermined guide slots. Rather than being confined to predefined slots, it would be desirable if a simulated soccer game were provided that does not employ guide slots for the simulated players.

U.S. Pat. No. 4,257,599 discloses a table top soccer game that is played with manually movable players. The manually movable players are generally disc-shaped and are adapted to slide on the table top in response to finger flicking force application. In addition, a missile is representative of a soccer ball. The missile has multiple sides and edges so that when struck by a moving slider, the missile will tumble in a generally linear direction come to rest as a result of repeatedly striking the table top with the missile positioned on the table top. Two disadvantages are associated with this table top soccer game. First, the manually movable players are adapted to being flicked by a finger. However, to propel a player accurately in a predetermined direction and to propel the player with a desired degree of force, finger flicking is a difficult to control form of propulsion. In this respect, it would be desirable if a table top soccer game were provided which did not employ finger flicking for propelling players.

A second disadvantage is associated with the table top soccer game in U.S. Pat. No. 4,257,599 is the so-called missile that is propelled by the finger flicking. The multiple sides and edges of the missile cause the missile to bounce around as it traverses the table top board. Such bouncing around makes straight shooting very difficult. In this respect, it would be desirable if a table top soccer game were provided which employed a simulated soccer ball that moves along a table top without bouncing around.

U.S. Pat. No. 4,274,635 discloses a combination soccer and hockey game board that employs a large number of stationary spaced obstructions. Such obstructions are not simulative of a real soccer or hockey game where real players are very mobile. In this respect, it would be desirable if a table top soccer game were provided which does not employ a large number of stationary obstructions on the board surface.

U.S. Pat. No. 5,092,595 discloses a table top soccer game apparatus which includes a plurality of stationary obstructions and a plurality of tally spheres mounted on a rack. As stated above, a plurality of stationary obstructions are objectionable. Moreover, the rack and tally spheres are an easily dispensed with feature. In this respect, it would be desirable if a table top soccer game were provided which did not include a rack with tally spheres.

U.S. Pat. No. Des. 246,674 discloses a table for a soccer game. The table is a dedicated device. That is, the table is used solely as a soccer game. Such a table takes up considerable space when the soccer game is not being played. In this respect, it would be desirable if a table top soccer game were provided which includes an overlay for a conventional table rather than having a dedicated table.

Still other features would be desirable in a table top soccer game apparatus. The game of hockey shares certain similarities with the game of soccer. Both have players, both have goals at the ends of a playing field, and both have a projectile that is directed to a goal. It would be desirable, then, of the players and the projectile used in table top soccer could also be used in a table top hockey game. In this respect, it would be desirable if a table top soccer game were provided that was capable of being converted into a table top hockey game.

When a soccer projectile or a hockey projectile is shot toward the boundaries of the playing field, the projectile may fall off of the table top. To prevent loss of the projectile, it would be desirable if the game had walls surrounding the boundaries to prevent the projectile from falling off of the table top.

Thus, while the foregoing body of prior art indicates it to be well known to use table top simulated soccer games, the prior art described above does not teach or suggest a table top soccer game apparatus which has the following combination of desirable features: (1) does not employ guide slots for the simulated players; (2) does not employ finger flicking for propelling players; (3) employs a simulated soccer ball that moves along a table top without bouncing around; (4) does not employ a large number of stationary obstructions on the board surface; (5) does not include a rack with tally spheres; (6) includes an overlay for a conventional table top; (7) is capable of being converted into a table top hockey game; and (8) has walls surrounding the boundaries to prevent the projectile from falling off of the table top. The foregoing desired characteristics are provided by the unique table top soccer game apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved table top soccer game apparatus which includes a planar simulated soccer field assembly adapted to be placed on a table top. The simulated soccer field assembly includes four passing zones, a first passing zone, a second passing zone, a third passing zone, and a fourth passing zone. The simulated soccer field assembly includes a first goal area and a second goal area located at opposite ends of the simulated soccer field assembly. A plurality of first players is comprised of a first team and a plurality of second players is comprised of a second team adapted to slide along the simulated soccer field assembly. The first players and the second players adapted to be propelled by a squeezing action between an index finger and a thumb, and a projectile adapted to be slid along the simulated soccer field assembly by is bumped by the propelled first players and the propelled second players. The projectile is in a form of a cylindrical shape. The first players are color coded with a first color, and the second players are color coded with a second color.

A wall assembly may be connected to the simulated soccer field assembly adjacent to a perimeter of the simulated soccer field assembly. The wall assembly projects upward from the simulated soccer field assembly.

An overlay assembly is provided which simulates a hockey rink. The overlay assembly is adapted to placed over the simulated soccer field assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved table top soccer game apparatus which has all of the advantages of the prior art and none of the disadvantages.

It is another object of the present invention to provide a new and improved table top soccer game apparatus which may be easily and efficiently manufactured and marketed.

It is a further object of the present invention to provide a new and improved table top soccer game apparatus which is of durable and reliable construction.

An even further object of the present invention is to provide a new and improved table top soccer game apparatus which is susceptible of a low cost of manufacture with regard to both materials and labor, and which accordingly is then susceptible of low prices of sale to the consuming public, thereby making such table top soccer game apparatus available to the buying public.

Still yet a further object of the present invention is to provide a new and improved table top soccer game apparatus which does not employ guide slots for the simulated players.

Still another object of the present invention is to provide a new and improved table top soccer game apparatus that does not employ finger flicking for propelling players.

Yet another object of the present invention is to provide a new and improved table top soccer game apparatus which employs a simulated soccer ball that moves along a table top without bouncing around.

Even another object of the present invention is to provide a new and improved table top soccer game apparatus that does not employ a large number of stationary obstructions on the board surface.

Still a further object of the present invention is to provide a new and improved table top soccer game apparatus which does not include a rack with tally spheres.

Yet another object of the present invention is to provide a new and improved table top soccer game apparatus that includes an overlay for a conventional table top.

Still another object of the present invention is to provide a new and improved table top soccer game apparatus which is capable of being converted into a table top hockey game.

Yet another object of the present invention is to provide a new and improved table top soccer game apparatus that has walls surrounding the boundaries to prevent the projectile from falling off of the table top.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is an enlarged bottom perspective view of a manually moved player portion of the table top soccer game apparatus of the invention.

FIG. 6 is a cross-sectional view of the manually moved player shown in FIG. 5 taken along line 6—6 in FIG. 5.

FIG. 7 is a perspective view of a projectile that can be used with a soccer or a hockey embodiment of the invention.

DESCRIPTION OF THE PREFERRED EMBODIMENT

Figure 1:
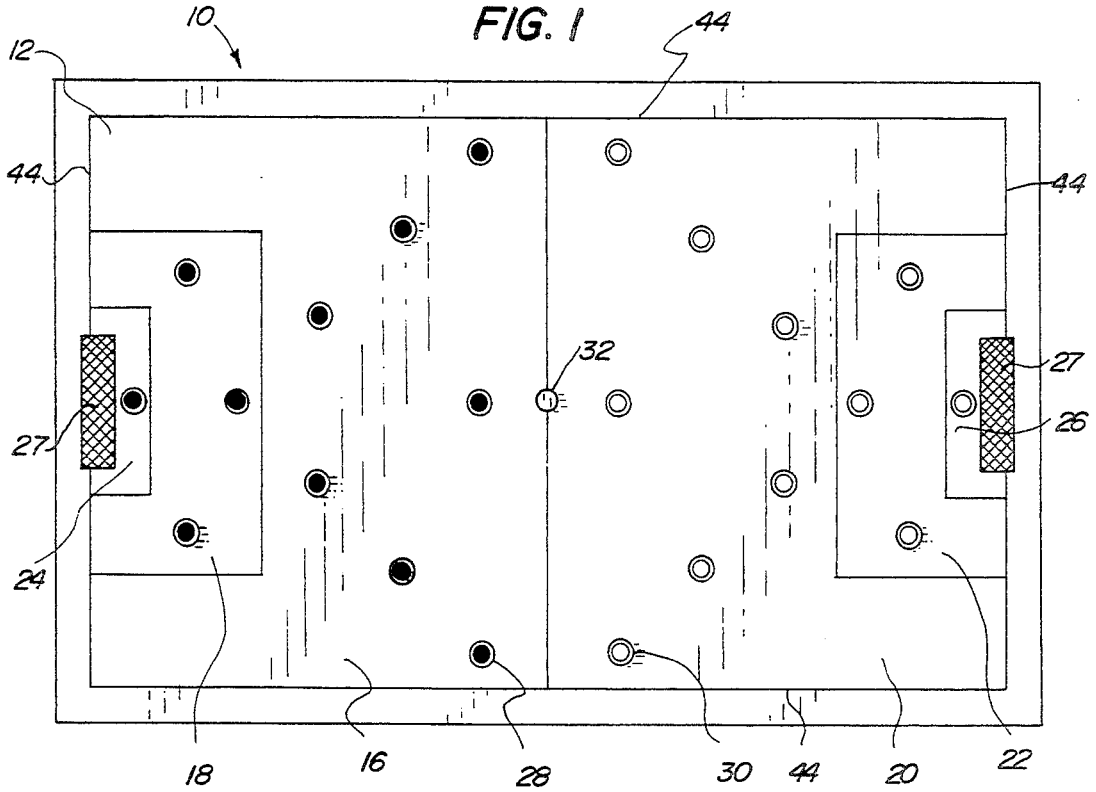
FIG. 1 is a top view showing a first preferred embodiment of the table top soccer game apparatus of the invention.
Figure 2:
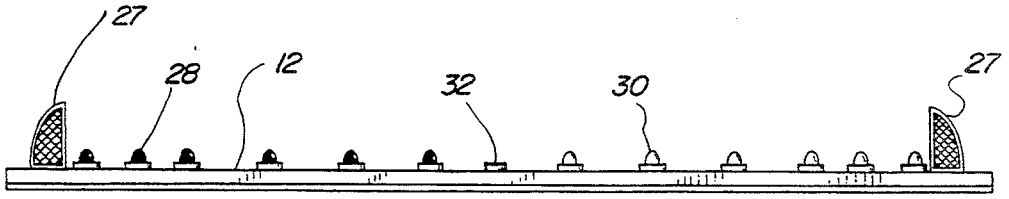
FIG. 2 is a side view of the embodiment of the table top soccer game apparatus shown in FIG. 1.
Figure 3:
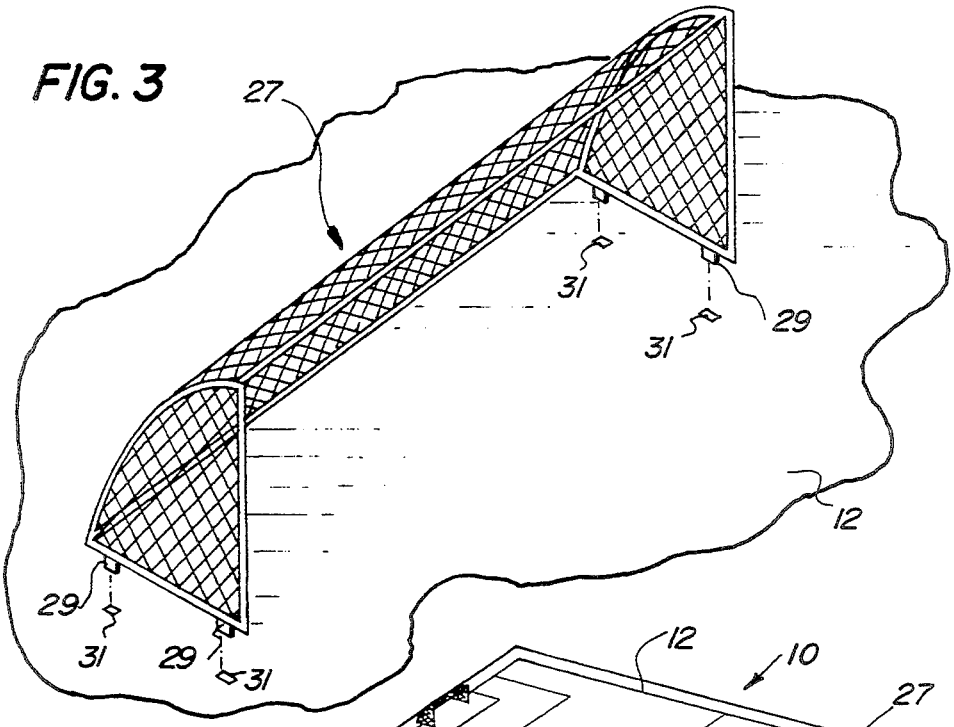
FIG. 3 is an enlarged perspective view of a goal portion of the embodiment of the table top soccer game apparatus of FIG. 1.
Figure 4:
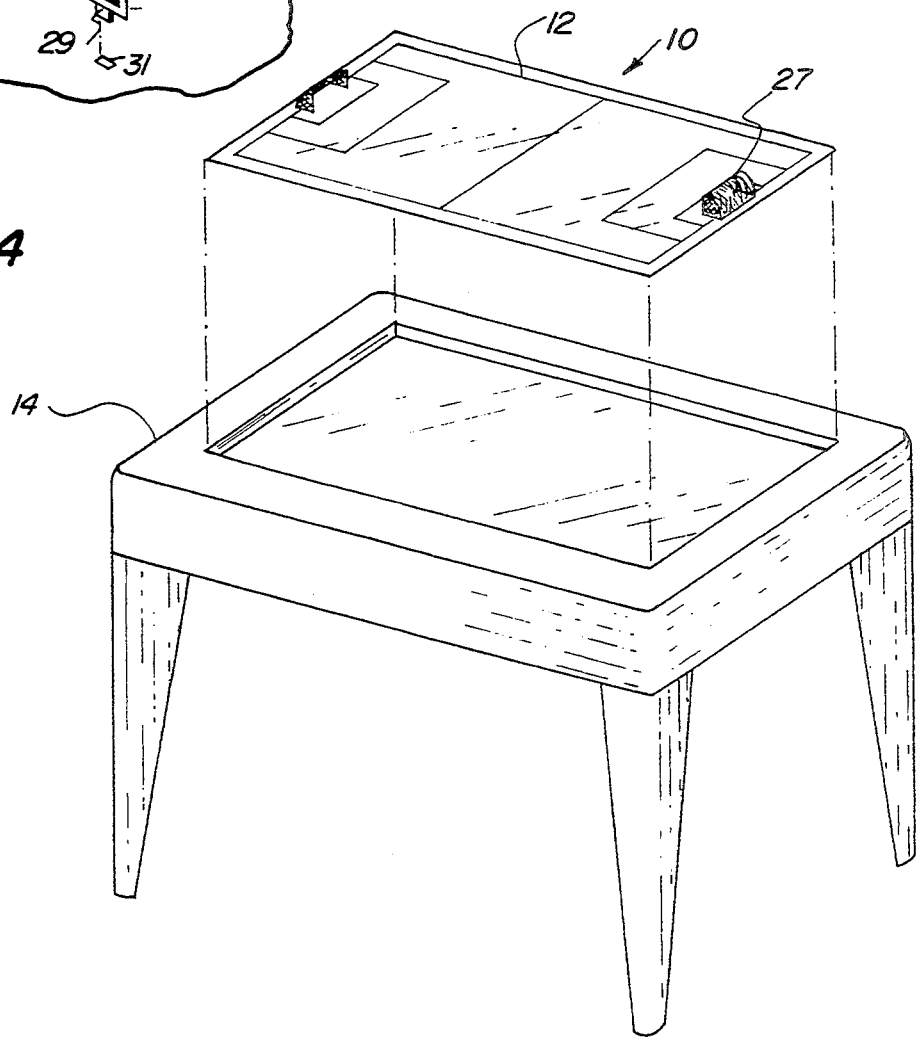
FIG. 4 is an exploded perspective view of the embodiment of the invention shown in FIG. 1 being ready to be placed on a table top.

With reference to the drawings, a new and improved table top soccer game apparatus embodying the principles and concepts of the present invention will be described.

Turning to FIGS. 1–7, there is shown a first exemplary embodiment of the table top soccer game apparatus of the invention generally designated by reference numeral 10. In its preferred form, table top soccer game apparatus 10 includes a planar simulated soccer field assembly 12 adapted to be placed on a table top 14. The simulated soccer field assembly 12 includes four passing zones, a first passing zone 16, a second passing zone 18, a third passing zone 20, and a fourth passing zone 22. The simulated soccer field assembly 12 includes a first goal area 24 and a second goal area 26 located at opposite ends of the simulated soccer field assembly 12. A plurality of first players 28 is comprised of a first team and a plurality of second players 30 is comprised of a second team adapted to slide along the simulated soccer field assembly 12. The first players 28 and the second players 30 adapted to be propelled by a squeezing action between an index finger and a thumb, and a projectile 32 adapted to be slid along the simulated soccer field assembly 12 by is bumped by the propelled first players 28 and the propelled second players 30. The projectile 32 is in a form of a cylindrical shape such as in the form of a hockey puck. The first players 28 are color coded with a first color such as black, and the second players 30 are color coded with a second color such as white.

More specifically, the simulated soccer field assembly 12 includes outside lines 44 at the periphery of the simulated soccer field assembly 12. There are eleven first players 28 and eleven second players 30. If desired, the players can be cloth covered bottle caps. Alternatively, the players can be in the form shown in FIGS. 5 and 6.

The object of the soccer game is to shoot the projectile 32 into either the first goal area 24 or the second goal area 26 depending upon which team is involved. The projectile 32 is not grasped directly by a person playing the game. Instead, a person grasps a first player 28 or a second player 30 between an index finger and a thumb and squeezes the player, whereby the player is squeezed out and propelled away from the person. The propelled player impacts the projectile 32, and the projectile 32 is projected toward a goal area.

Instead of trying to bounce the projectile 32 into a goal area directly off of a squeezed and propelled player 28 or 30, the squeezed player may be aimed at the projectile 32 to cause the projectile 32 to bump into another team mate player 28 or 30. Such a maneuver is referred to as a pass, and there are four passing zones, the first passing zone 16, the second passing zone 18, the third passing zone 20, and the fourth passing zone 22.

Some specific rules of simulated soccer play may be as follows. If the projectile 32 goes out of bounds. A player on the opposing team gets a free kick. Hitting an opposing player with first making contact with the projectile 32 results in a free kick for the opposing team. If a player 28 or 30 is propelled off of the simulated soccer field assembly 12, that player is placed at is own goal line. The length of the game can consist of two fifteen minute halves. To facilitate play of the game. A printed set of official rules can accompany the game.

The first goal area 24 and the second goal area 26 can include net assemblies 27. The net assemblies 27 can include protuberances 29 which connect with complementary wells 31.

As shown in FIGS. 5 and 6, a representative first player 28 can include a bottom surface that includes a form of a fuzz 33 for providing a relatively low coefficient of friction between the fuzz 33 and the simulated soccer field assembly 12 when the first players 28 are propelled along the simulated soccer field assembly 12. The players can includes an internally housed weight member 35 that provides the player with a low center of gravity and helps prevent a player from flipping over during play.

Figure 8:
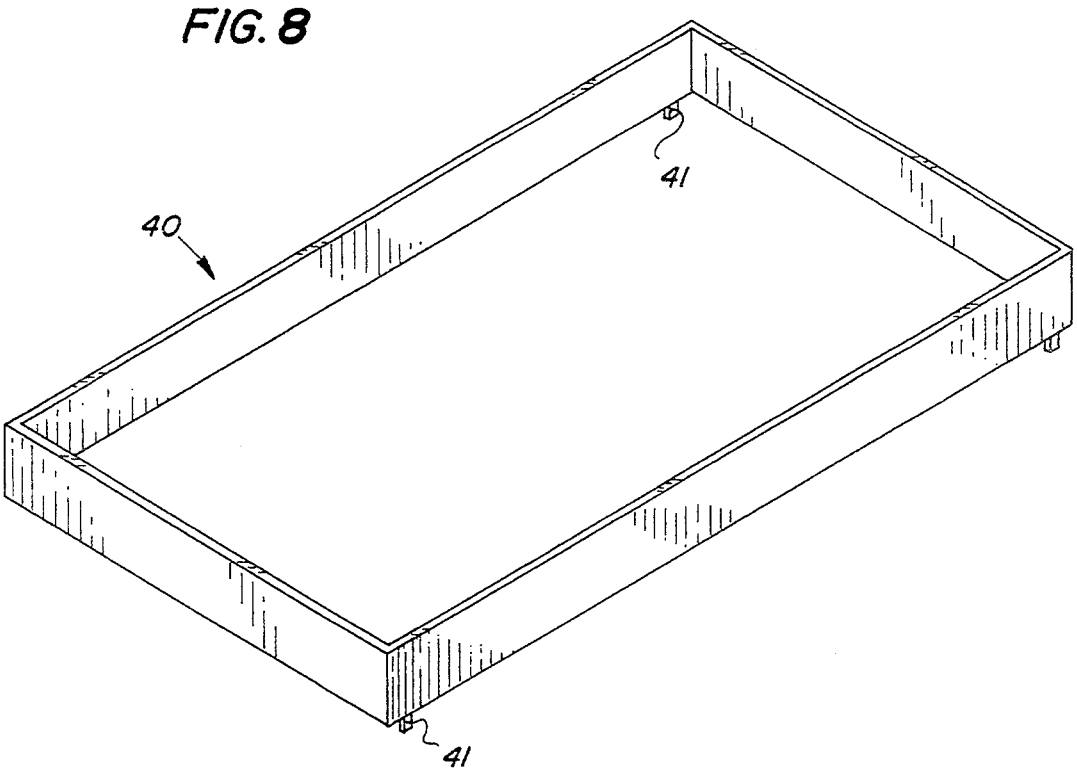
FIG. 8 is a perspective view of a portion of a second embodiment of the invention wherein a wall assembly is provided for a table top soccer or hockey game of the invention.

Turning to FIG. 8, a second embodiment of the invention is shown. Reference numerals are shown that correspond to like reference numerals that designate like elements shown in the other figures. In addition, a wall assembly 40 is connected to the simulated soccer field assembly 12 adjacent to a perimeter of the simulated soccer field assembly 12. The wall assembly 40 projects upward from the simulated soccer field assembly 12. With a wall assembly 40, the projectile 32 can be bounced off of the wall assembly 40 as part of either a passing operation or a direct shot at the goal. The wall assembly 40 and the simulated soccer field assembly 12 can be fabricated into a unified integrated structure. Also, as shown in FIG. 8, the wall assembly 40 can includes protuberances 41 that are adapted to fit into complementary wells in the simulated soccer field assembly 12.

Figure 9:
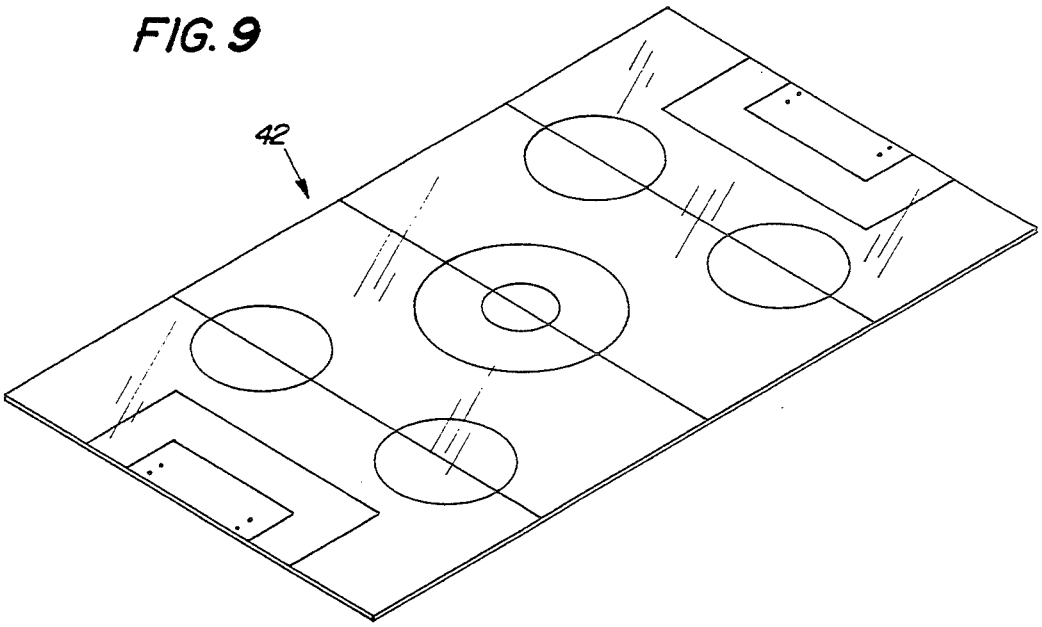
FIG. 9 is a perspective view of a third embodiment of the invention wherein a table top overlay of a hockey game rink is provided.

Turning to FIG. 9, a third embodiment of the invention is shown. Reference numerals are shown that correspond to like reference numerals that designate like elements shown in the other figures. In addition, an overlay assembly 42 is provided which simulates a hockey rink. The overlay assembly 42 is adapted to placed over the simulated soccer field assembly 12. The overlay assembly 42 can be made of a clear plastic material imprinted with a simulated hockey rink.

A variety of versions of the table top soccer game apparatus of the invention can be produced. For example, with one version of the invention the simulated soccer field assembly 12 is 7 feet long and 4 feet wide. There would be 11 players on each side, and this version can be used for domestic and international competitions.

A smaller version of the invention includes a simulated soccer field assembly 12 that is 5 feet long and 3 feet wide. In this smaller version, there can be 8 players on each side.

An even smaller version of the simulated soccer field assembly 12 may measure 4 feet in length and 2 feet in width. Such a small version may be especially suitable for children. For such a children's version of the table top soccer game apparatus of the invention, the wall assembly 40 shown in FIG. 8 may be especially useful.

The components of the table top soccer game apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved table top soccer game apparatus that is low in cost, relatively simple in design and operation, and which may advantageously be used without employing guide slots for the simulated players. With the invention, a table top soccer game apparatus is provided which does not employ finger flicking for propelling players. With the invention, a table top soccer game apparatus is provided which employs a simulated soccer ball that moves along a table top without bouncing around. With the invention, a table top soccer game apparatus is provided which does not employ a large number of stationary obstructions on the board surface. With the invention, a table top soccer game apparatus is provided which does not include a rack with tally spheres. With the invention, a table top soccer game apparatus is provided which includes an overlay for a conventional table top. With the invention, a table top soccer game apparatus is provided which is capable of being converted into a table top hockey game. With the invention, a table top soccer game apparatus is provided which has walls surrounding the boundaries to prevent the projectile from falling off of the table top.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved table top soccer game apparatus, comprising:

a planar simulated soccer field assembly adapted to be placed on a table top, said simulated soccer field assembly including four passing zones, a first passing zone, a second passing zone, a third passing zone, and a fourth passing zone, said simulated soccer field assembly including a first goal area and a second goal area located at opposite ends of said simulated soccer field assembly, a plurality of first players color coded with a first color comprising a first team and a plurality of second players color coded with a second color comprising a second team adapted to slide along said simulated soccer field assembly, said first players and said second players including round outer surfaces such that said first and second players are adapted to be propelled by a squeezing action between an index finger and a thumb, a cylindrically shaped projectile adapted to be slid along said simulated soccer field assembly by being bumped by said propelled first players and said propelled second players, which are propelled by the squeezing action between the index finger and the thumb, a wall assembly connected to said simulated soccer field assembly adjacent to a perimeter of said simulated soccer field assembly, said wall assembly projecting upward from said simulated soccer field assembly, and an overlay assembly which simulates a hockey rink, said overlay assembly adapted to be placed over said simulated soccer field assembly.

* * * * *